US007926906B2

(12) United States Patent
Masuda et al.

(10) Patent No.: US 7,926,906 B2
(45) Date of Patent: Apr. 19, 2011

(54) INK JET PRINTING APPARATUS AND INK ABSORBER RECOVERY METHOD

(75) Inventors: Satoshi Masuda, Kawasaki (JP); Osamu Iwasaki, Tokyo (JP); Yoshinori Nakagawa, Kawasaki (JP); Atsuhiko Masuyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 482 days.

(21) Appl. No.: 11/945,585

(22) Filed: Nov. 27, 2007

(65) Prior Publication Data

US 2008/0150990 A1 Jun. 26, 2008

(30) Foreign Application Priority Data

Dec. 21, 2006 (JP) ..... 2006-344635

(51) Int. Cl.
*B41J 2/165* (2006.01)

(52) U.S. Cl. ..... 347/36; 347/5; 347/14

(58) Field of Classification Search ..... 347/5, 9, 347/19, 34, 35, 36, 14
See application file for complete search history.

(56) References Cited

U.S. PATENT DOCUMENTS 5,801,721 A * 9/1998 Gandy et al. ..... 347/3
6,820,962 B2 11/2004 Uchida

FOREIGN PATENT DOCUMENTS

JP 2004-025557 1/2004

* cited by examiner

*Primary Examiner* — Lam S Nguyen
(74) *Attorney, Agent, or Firm* — Fitzpatrick, Cella, Harper & Scinto

(57) ABSTRACT

A necessary amount of suppression ink is applied to each portion of an ink absorber in a short time and in an efficient manner. For that end, carriage scan is performed while changing an ejection condition of suppression ink so as to change an application amount of suppression ink according to a position of an ink absorber. This makes it possible to appropriately apply suppression ink, which suppresses accumulation of ink, to the entire area of the ink absorber by carriage scan in a short time even if an application amount of accumulation ink differs from part to part of the ink absorber.

8 Claims, 10 Drawing Sheets

INK JET PRINTING APPARATUS AND INK ABSORBER RECOVERY METHOD

BACKGROUND OF THE INVENTION

1. Field of the Invention

The present invention relates to an ink jet printing apparatus that performs printing by moving a printing head in directions intersecting with a transfer direction of a printing medium. Particularly, the present invention relates to a recovery method for maintaining absorption capability of an ink absorber. The ink absorber absorbs ink ejected on an area outside the edge portions of the printing medium, when performing so-called "marginless printing" where printing is carried out with no margin provided on the edge portions of the printing medium.

2. Description of the Related Art

In recent years, ink jet printing apparatuses which eject ink from nozzles of a printing head are widely used as computer output apparatuses. Provided are many of such apparatuses which can print an image on the edges of a printing medium and output a printed matter with no margin. In the ink jet printing apparatus that performs "marginless printing," ink is ejected on an area outside the utmost edges of the printing medium for printing an image. At this time, an ink absorber is provided at a position opposing to a passage where a printing head moves, and absorbs ink in order to prevent ink ejected on such an outside area from polluting the interior of the apparatus.

However, in ink to be used, for example, there is pigmented ink that is not easily absorbed by the ink absorber and such ink tends to be gradually accumulated on the surface of the ink absorber. As the accumulation of ink progresses, various troubles occur such as transfer failure of a printing medium, ink stains on the back surface of the printing medium, damage of an ejection port surface of the printing head due to contact between the ejection port surface and accumulated ink and the like.

Japanese Patent Laid-Open No. 2004-25557 discloses the following technique to solve the foregoing problems. Specifically, by ejecting easily-absorbable ink onto an area of an ink absorber to which hardly-absorbable ink is already applied, the absorption capability of the ink absorber is exerted more and the accumulation of ink on the ink absorber is suppressed.

In the present specification, the ink hardly absorbed by the ink absorber, which easily accumulates on the absorber, is hereinafter called accumulation ink. The ink easily absorbed by the ink absorber, which suppresses the accumulation on the absorber, is hereinafter called suppression ink.

Incidentally, in an ink jet printing apparatus performs "marginless printing," the amount of ink to be applied per unit area of the ink absorber provided in the apparatus is not uniform.

FIG. 8 is a schematic view for illustrating an ink absorber and positional variations of the amount of ink applied. A printing medium P placed at the position shown in FIG. 8 before starting "marginless printing" is transferred in the transfer direction upon start of printing operation. Then, the printing medium P is positioned so that it's leading portion f (not illustrated) should be disposed above an ink absorber 208A on an area printable by a printing head. After that, the printing head starts printing on a portion in the vicinity of the leading portion f while moving in the main scanning directions in FIG. 8. Here, if the size of the printing medium is assumed to be A4, the ink ejected onto an area outside the printing medium is absorbed by the absorber 208A over the entire area including the right edge portion, the left edge portion and the leading and trailing portion. Additionally, the printing head generally includes a plurality of nozzles in the transfer direction, but, sometimes, not all the nozzles are used at the time of printing the leading portion or the trailing portion in the case of "marginless printing."

The ink jet printing apparatus intermittently performs a print scan in main scanning directions using the printing head and a transfer operation of the printing medium in the directions intersecting with the main scanning directions, whereby an image is gradually printed. Accordingly, when printing on the leading portion f of the printing medium progresses to an extent that reaches beyond the ink absorber 208A, printing on the leading portion f is completed and no ink is ejected to the leading and trailing portion toward the ink absorber 208A. In other words, the area where the ink is ejected on outside of the printing medium is only the left edge portion and the right edge portion. When this stage is reached, all nozzles of the printing head is used for printing, and therefore the length of the ink absorber 208A in the transfer direction at the right and left edge portions is generally designed to be longer than that of the leading and trailing portion. However, since the size of the printing medium is not limited to A4, the position of the right edge portion varies according to the size of the printing medium taking the left edge portion side as a base. Accordingly, as illustrated in the figure, some positions for the right edge portion where the absorber can be widened according to the type of the printing medium are generally prepared.

When the print scan and the transfer operation are thus carried out and the trailing portion R of the printing medium reaches the vicinity of the absorber 208A, the trailing portion R is printed in a state that a number of nozzles is reduced again. Thereafter, the ink to be ejected on the outside area during the printing on the trailing portion is absorbed over substantially entire absorber 208A including the right edge portion, the left edge portion and the leading and trailing portion, similar to the case of the printing on the leading portion. When the printing on the trailing portion is completed, the printing medium is discharged to the outside of the apparatus.

In the foregoing series of printing operations of one printing medium, it is understood that portions to which the amount of ink is applied most are right and left edge portions in the area of the ink absorber 208A. This is because the ink is continued to be applied to the right end portion and the left edge portion in the series of printing operations, but no ink is applied to the leading and trailing portion during the printing on the central portion of the printing medium. As a result, in the ink jet printing apparatus that performs printing using ink (accumulation ink) which is not easily absorbed by the ink absorber, ink is easily accumulated on the right and left edge portions as compared with the other portions. In other words, in the case of applying suppression ink to suppress the accumulation of ink on the absorber as described in Japanese Patent Laid-Open No. 2004-25557, a necessary amount of suppression ink applied differs depending on the portion of the ink absorber.

However, in the technique described in Japanese Patent Laid-Open No. 2004-25557, suppression ink is ejected from the plurality of nozzles at a fixed drive frequency while moving the carriage having the printing head at a constant speed, so that a substantially constant amount of suppression ink is applied to any portion of the absorber. This causes a problem that the necessary amount of ink applied cannot be obtained according to the amount of accumulation ink applied to the right and left edge portions.

SUMMARY OF THE INVENTION

The present invention has been made in view of the foregoing problem. An object of the present invention is to provide an ink jet printing apparatus that is capable of applying a necessary amount of suppression ink to each portion of an ink absorber in a short time as possible and in an efficient manner, and to provide an ink absorber recovery method.

The first aspect of the present invention is an ink jet printing apparatus capable of making a print without providing a margin on edge portions of a printing medium by ejecting at least a first ink from a printing head to the printing medium and the outside of the printing medium while moving a printing head capable of ejecting the first ink and a second ink onto the printing medium, comprising: an ink absorber that absorbs the first and second inks ejected to the outside of the printing medium; and a control section that controls ejection of the second ink from the printing head such that the second ink is ejected to the ink absorber to which the first ink is ejected in order to suppress accumulation of the first ink on the ink absorber, wherein the control section changes an ejection condition of the second ink according to a position of the ink absorber.

The second aspect of the present invention is an ink absorber recovery method in an ink jet printing apparatus having an ink absorber for absorbing ink ejected to the outside of a printing medium, comprising the steps of: ejecting at least a first ink from a printing head to a printing medium and to the outside of the printing medium while moving the printing head relative to the printing medium, thereby making a print without providing a margin on edge portions of the printing medium, the printing head being can eject the first ink and a second ink for suppressing accumulation of the first ink on the ink absorber; and changing an ejection condition of the second ink according to a position of the ink absorber in order to eject the second ink from the printing head in such a way that the second ink is ejected to a position of the ink absorber to which the first ink is ejected.

Further features of the present invention will become apparent from the following description of exemplary embodiments (with reference to the attached drawings).

DESCRIPTION OF THE EMBODIMENTS

First Embodiment

The following will specifically explain embodiments of the present invention with reference to drawings.

Figure 1:
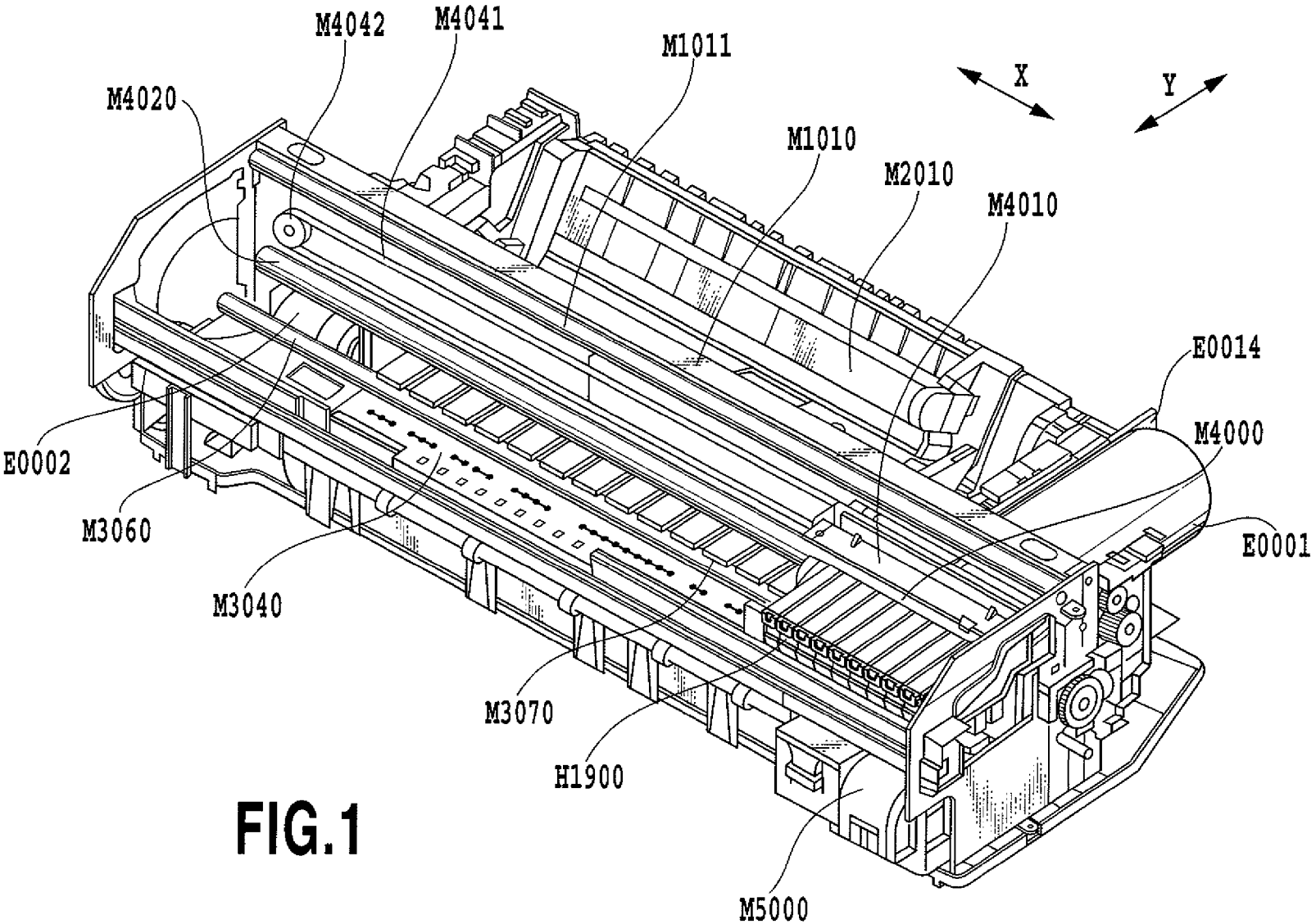
FIG. 1 is a perspective view for illustrating an ink jet printing apparatus applied to an embodiment of the present invention in a state that its outer case is detached to expose its internal mechanism.

FIG. 1 is a perspective view for illustrating an ink jet printing apparatus applied to an embodiment of the present invention in a state that its outer case is detached to expose its internal mechanism. The main body of the printing apparatus in this embodiment includes a paper feeding section, a paper transfer section, a paper delivery section, a carriage section, a cleaning section, a platen section and an outer section.

The paper feeding section separates printing media stacked on a platen M2010 and feeds them to a printing section one by one. The paper transfer section has a pair of rollers, which includes a transfer roller M3060 that transfers the fed printing medium to a printing area of a printing head in a sandwiching manner and a pinch roller M3070 provided opposite thereto, and a transfer motor E0002 serving as a drive source of the transfer roller M3060.

The paper delivery section has a paper delivery roller M3100 that delivers the printing medium from the printing area and a plurality of spur rollers M3120 working in cooperation with the paper delivery roller M3100.

The carriage section has a carriage M4000 for attaching a head cartridge H1000 and an ink tank H1900. The carriage M4000 is supported by a guide shaft M4020 and a guide rail M1011. The guide shaft M4020 guides and supports the carriage M4000 in a direction (X direction) perpendicular to a printing medium transferring direction (Y direction). A driving force of a carriage motor E0001 attached to a chassis M1010 causes the carriage M4000 to reciprocate in the X direction through a timing belt M4041 tightly stretched by two pulleys M4042.

In the area where the printing head performs printing, a platen M3040 is provided to support the transferred printing medium from below and constantly maintain a distance between a surface of the printing medium and an ejection port surface of the printing head. The structure of the platen M3040 will be specifically described later.

In the case of printing an image on the printing medium with the foregoing configuration, a printing position to a row direction of the image is positioned by the pair of rollers consisting of the transfer roller M3060 and the pinch roller M3070 transferring the printing medium. Moreover, the position of the image to the column direction of the image is positioned by the carriage M4000 moving in directions intersecting with the transfer direction. The positioned printing head ejects ink to the printing medium according to a signal sent from an electric control substrate E0014. Regarding the printing apparatus in this embodiment, by intermittently repeating a print scan where the carriage M4000 moves in the column direction while the printing head is performing printing and a transfer operation where the printing medium is transferred in the row direction by the transfer roller M3060, an image is printed on the printing medium. In addition, a specific confirmation of the printing head will be described later.

Figure 2:
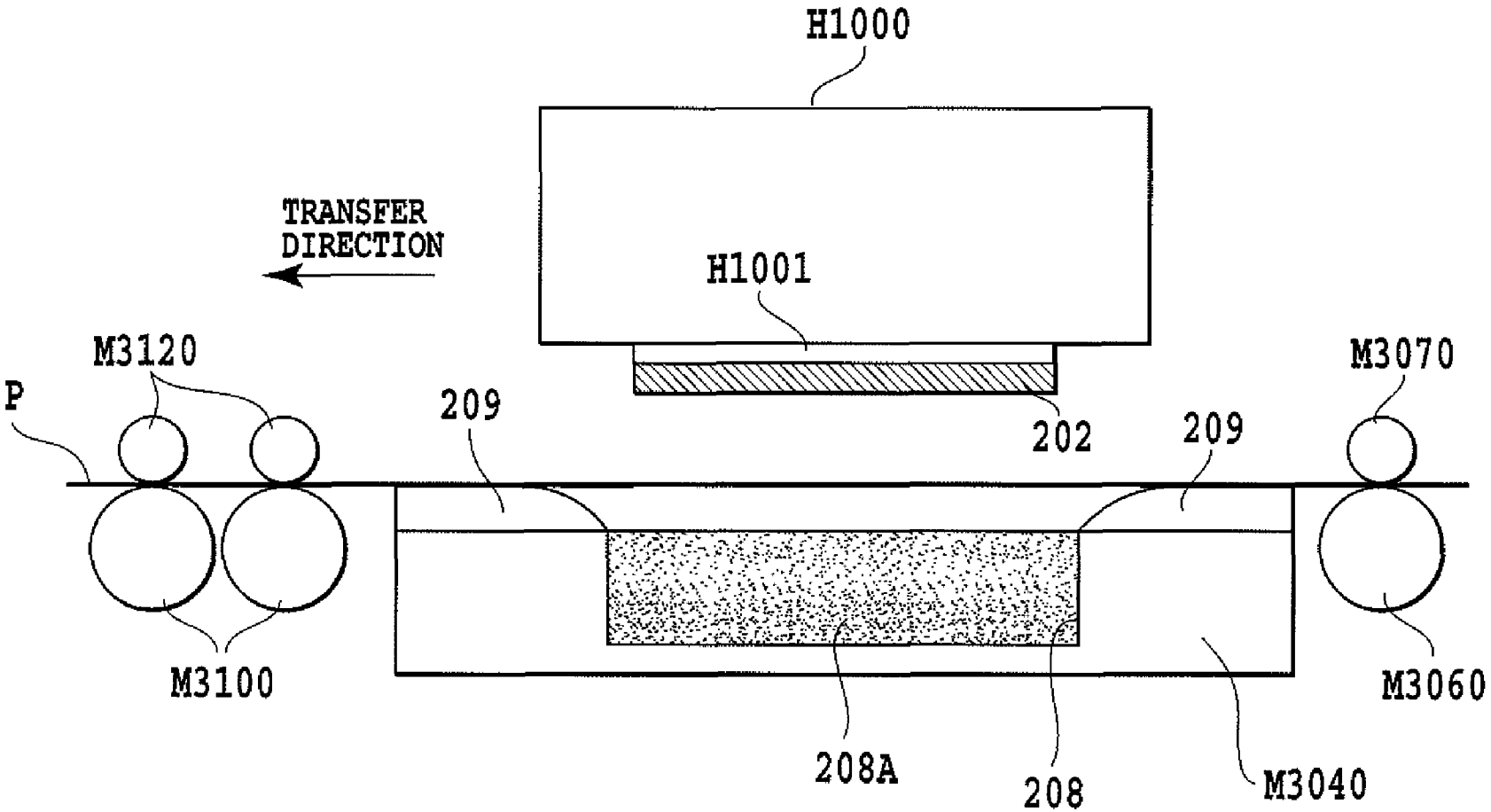
FIG. 2 is a cross-sectional view for specifically illustrating a state of a print section in the ink jet printing apparatus.

FIG. 2 is a cross-sectional view for specifically illustrating a configuration of a print section in the ink jet printing apparatus of this embodiment. The printing medium P transferred to the print section is provided such that its upstream side is held between the transfer roller M3060 and the pinch roller M3070 and its downstream side is held between the paper delivery rollers M3100 and the spur rollers M3120 to maintain a flat surface. A plurality of nozzle columns 202 provided in the printing head H1001 eject ink along with movement of the head cartridge H1000 in the vertical direction in the figure and prints an image for one print scan on the printing medium P.

The platen M3040 extends in the vertical direction in the figure along a passage where the printing head moves in order to support the printing medium passing above the platen M3040. The platen M3040 has ribs 209 for directly supporting the printing medium and a groove 208 for containing ink ejected on the outside area of the printing medium in performing "marginless printing", and the ink absorber 208A is filled in the groove 208. Moreover, ink absorbed by the ink absorber 208A is to be collected by a not-illustrated waste ink absorber provided at the lower portion of the main body of the printing apparatus. Additionally, in this embodiment, it is assumed that ink is applied up to an area, which overruns the size of the printing medium by about 3 mm, from the printing head H1001 in performing "marginless printing."

Figure 3:
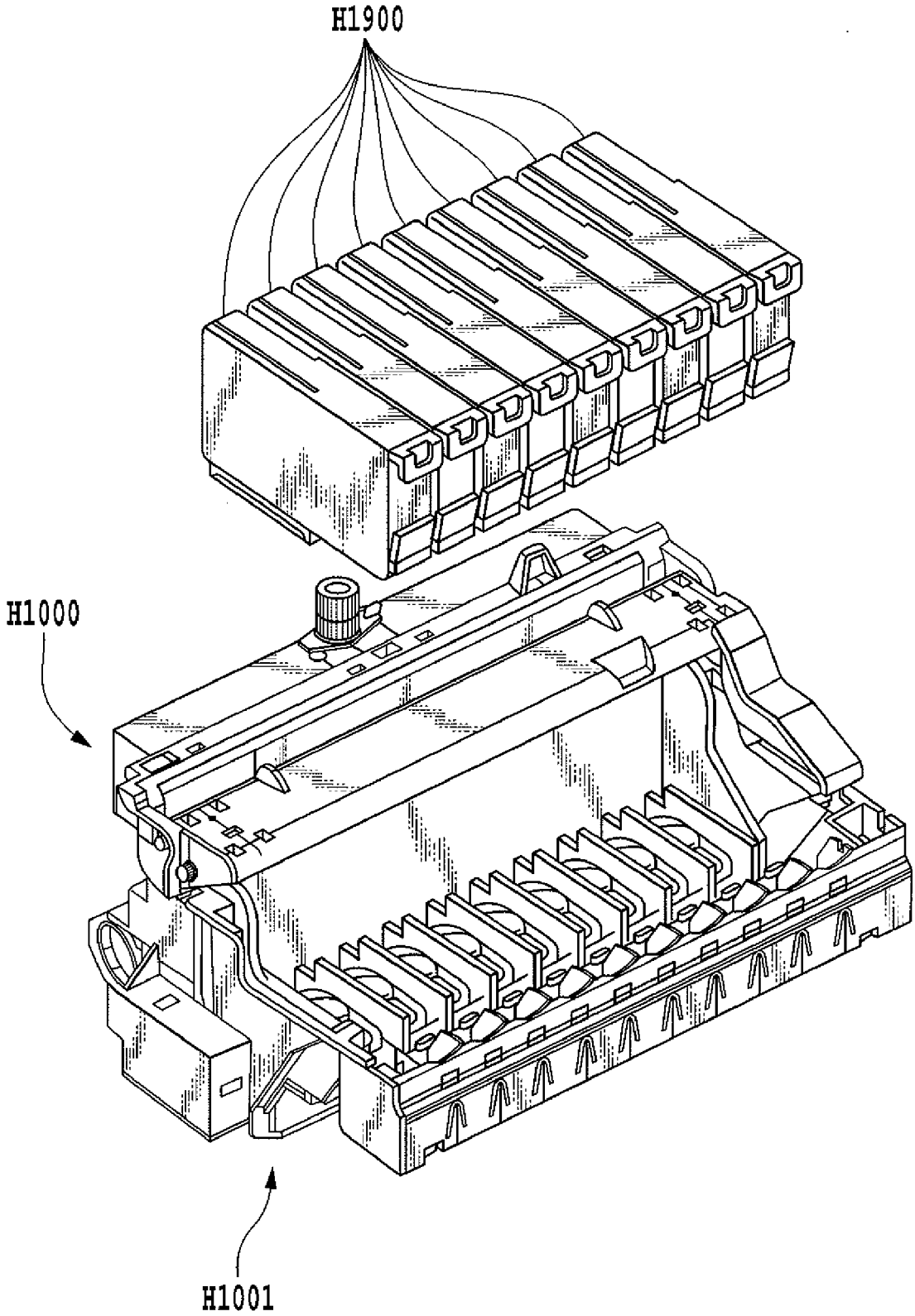
FIG. 3 is a perspective view for illustrating a configuration of a head cartridge.

FIG. 3 is a perspective view for illustrating a configuration of the head cartridge H1000 of this embodiment. The head cartridge H1000 of this embodiment has the printing head H1001, means for mounting the ink tank H1900 and means for supplying ink to the printing head H1001 from the ink tank H1900. The head cartridge H1000 is mounted on the carriage M4000 to be attachable thereto and detachable therefrom. In the figure, nine ink tanks H1900 are mounted on the head cartridge H1000. The printing apparatus of this embodiment is one that prints an image using ink of nine types and has nine ink tanks H1900, which are independently prepared. Each of these ink tanks is made attachable to and detachable from the head cartridge H1000. Attachment and detachment of each ink tank H1900 can be carried out with the head cartridge H1000 mounted on the carriage M4000.

Figure 4:
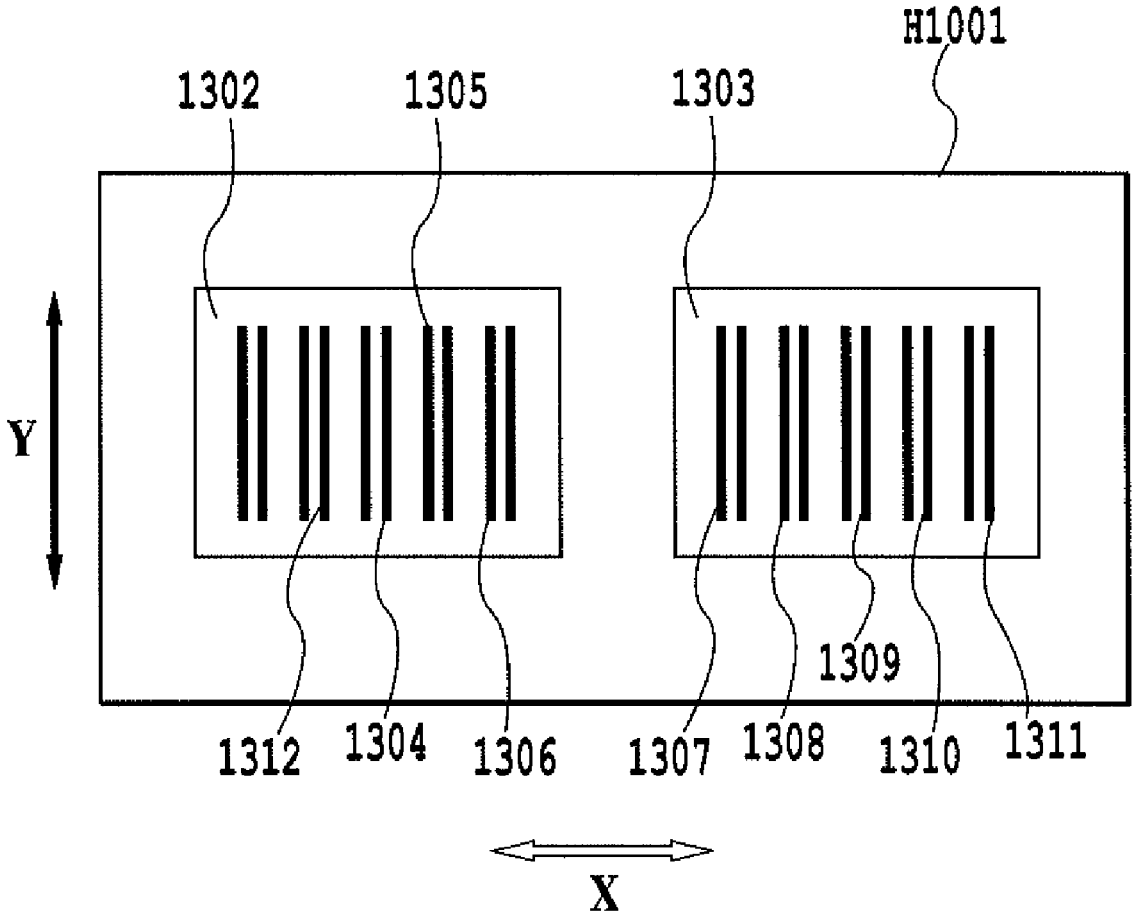
FIG. 4 is a schematic view for illustrating nozzle columns formed in a printing head.

FIG. 4 is a schematic view for illustrating nozzle columns provided in the printing head H1001. In the printing head H1001 of this embodiment, two printing element substrates 1302 and 1303, each having five nozzle columns, are arranged in parallel as illustrated in the figure.

In the first printing element substrate 1302, there are provided nozzle columns that can eject pigmented ink for use in printing a full color image at high speed based on a subtractive color mixing. In the figure, reference numeral 1312 indicates a nozzle column that ejects pigmented black ink, 1304 indicates a nozzle column that ejects pigmented yellow ink, 1305 indicates a nozzle column that ejects pigmented magenta ink, and 1306 indicates a nozzle column that ejects pigmented cyan ink. Each of the nozzle columns is made up of 768 nozzles arranged at intervals of 1200 dpi in the Y direction and each nozzle ejects ink droplets of about 2 pico-liters. Additionally, in the figure, the nozzle column shown on the left side of the nozzle column 1312 is a non-used nozzle column in this embodiment.

In the second printing element substrate 1303, there are provided nozzle columns that can eject dye ink for improving gradation characteristics when printing a full color image with high image quality based on a subtractive color mixing. In the figure, reference numeral 1307 indicates a nozzle column that ejects dye light cyan ink, 1308 indicates a nozzle column that ejects dye black ink and 1309 indicates a nozzle column that ejects dye light magenta ink. Moreover, 1310 indicates a nozzle column that ejects dye gray ink and 1311 indicates a nozzle column that ejects dye particular color ink. Light cyan ink and light magenta ink are used together with cyan ink and magenta ink ejected from the printing element substrate 1302, thereby improves gradation characteristics of the color gamut where cyan and magenta are used. Dye black ink and gray ink are used together with pigmented black ink ejected from the printing element substrate 1302, thereby making possible improvement in image contrast and gradation characteristics. Furthermore, using the particular color ink, for example, red ink makes it possible to further expand the color gamut that can be represented with magenta, light magenta and yellow ink used in this embodiment. In this embodiment, among ink of nine types used here, pigmented ink, which has a large color material particle and is not easily dissolved with water, is classified as accumulation ink since such ink is not easily absorbed by the ink absorber. Meanwhile, dye ink, which has a small color material particle and is easily dissolved with water, is classified as suppression ink since such ink is easily absorbed by the ink absorber and helps pigmented ink to be absorbed.

Figure 5:
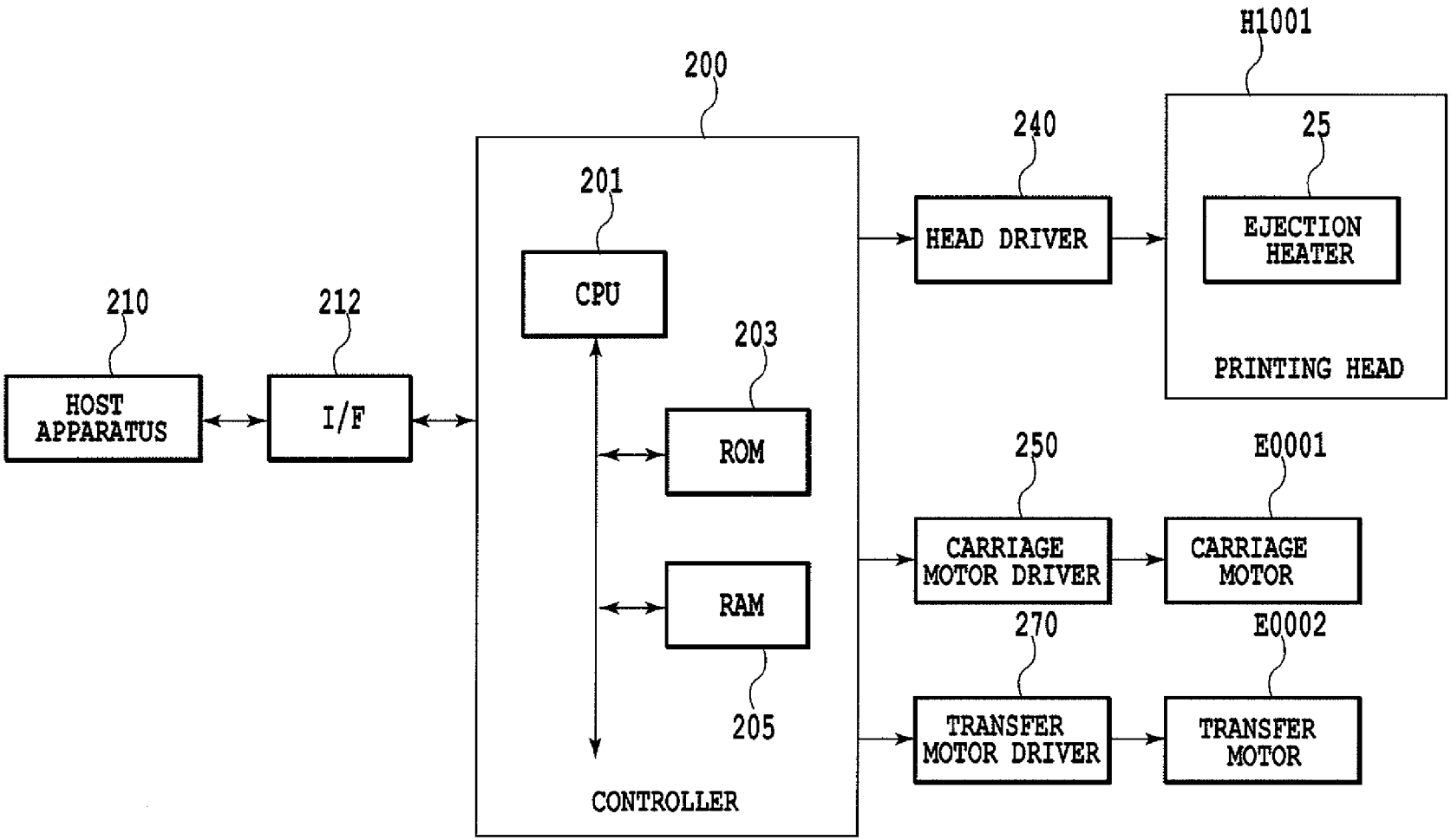
FIG. 5 is a block diagram for illustrating a control configuration in the ink jet printing apparatus applied to the embodiment of the present invention.

FIG. 5 is a block diagram for illustrating a control configuration in the ink jet printing apparatus of this embodiment. Reference numeral 200 indicates a controller that acquires information from each mechanism in the apparatus and transmits a command thereto, thereby controlling of the entire apparatus. The controller 200 includes a CPU 201, a ROM 203 that stores various kinds of programs and a RAM 205 that is used as a working area for CPU 201. The ROM 203 stores tables necessary for print control, fixed data, and suppression ink application scan to be described later, in addition to the foregoing programs.

A host apparatus 210 connected to the printing apparatus is a supply source of image data, but may take any form such as a computer that creates and processes data such as an image relating to printing, a reader section for image reading, and the like. Image data, other commands, a status signal and the like are transmitted and received between the host apparatus 210 and the controller 200 via an interface (I/f) 212. In the printing apparatus of this embodiment, image data, which is transmitted to the controller 200 from the host apparatus 210, is a multi-valued signal of 600 ppi (pixel/inch) and print data, which is printed on the printing medium by the printing head H1001, is a binary signal of 1200 dpi (dot/inch). In other words, the controller 200 converts the multi-valued signal of 600 ppi to the binary signal of 1200 dpi for nine colors when performing printing.

A head driver 240 is a driver that drives an electric thermal converter (ejection heater) 25 according to binary print data. A carriage motor driver 250 is a driver that drives the carriage motor E0001 that moves the carriage M4000, and a transfer motor driver 270 is a driver that drives the transfer motor E0002 for transferring the printing medium in the transfer direction.

The following will explain an ink absorber recovery method peculiar to this embodiment using the above-configured ink jet printing apparatus.

Figure 6:
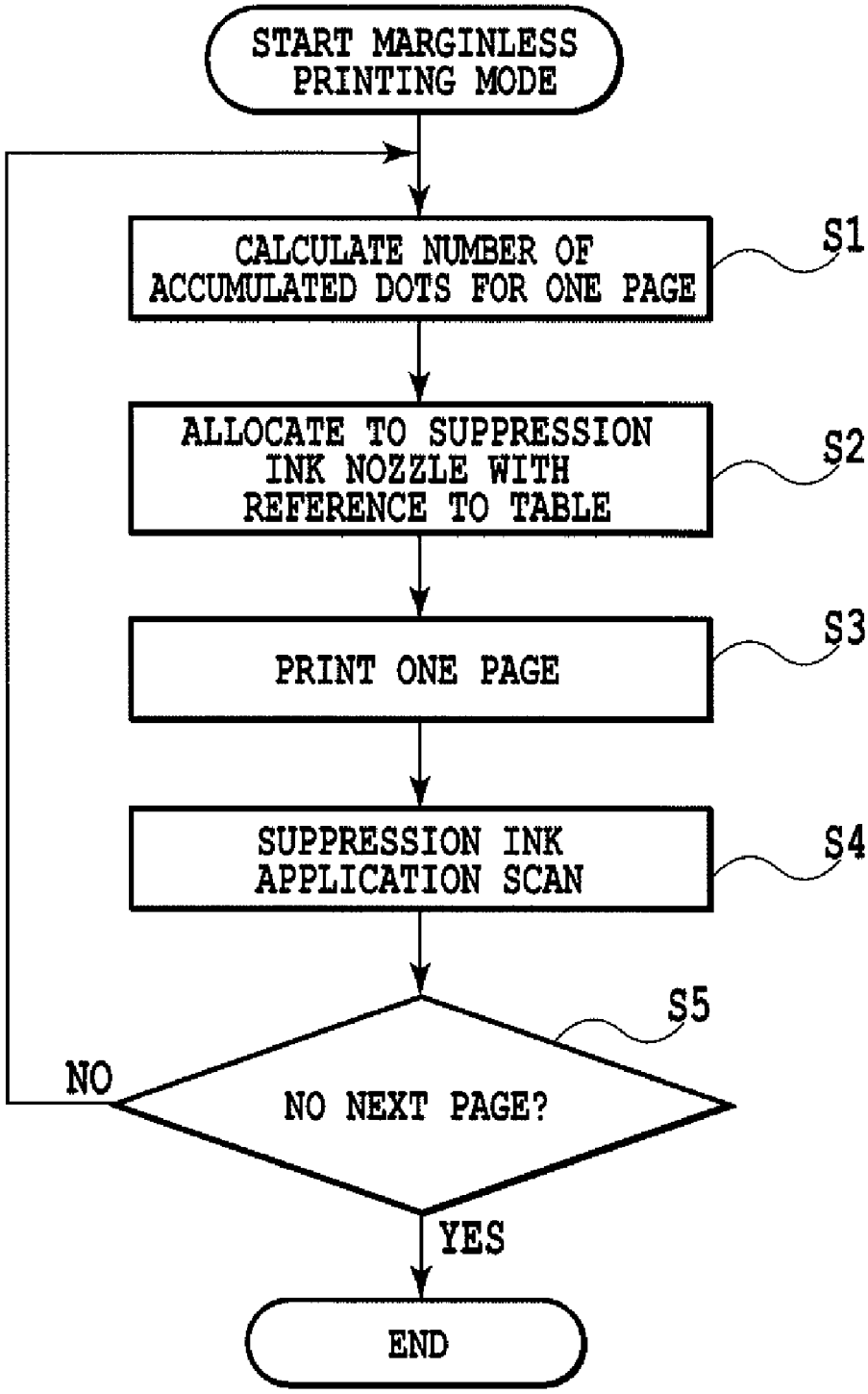
FIG. 6 is a flowchart for illustrating each process to be executed by a controller when an ink jet printing apparatus applicable to the present invention performs "marginless printing"

FIG. 6 is a flowchart for illustrating each process to be executed by the controller 200 when the ink jet printing apparatus of this embodiment performs "marginless printing."

When receiving a command of "marginless printing" from the host apparatus, the controller 200 first calculates the number of accumulated dots in outside area in step S1.

Figure 7:
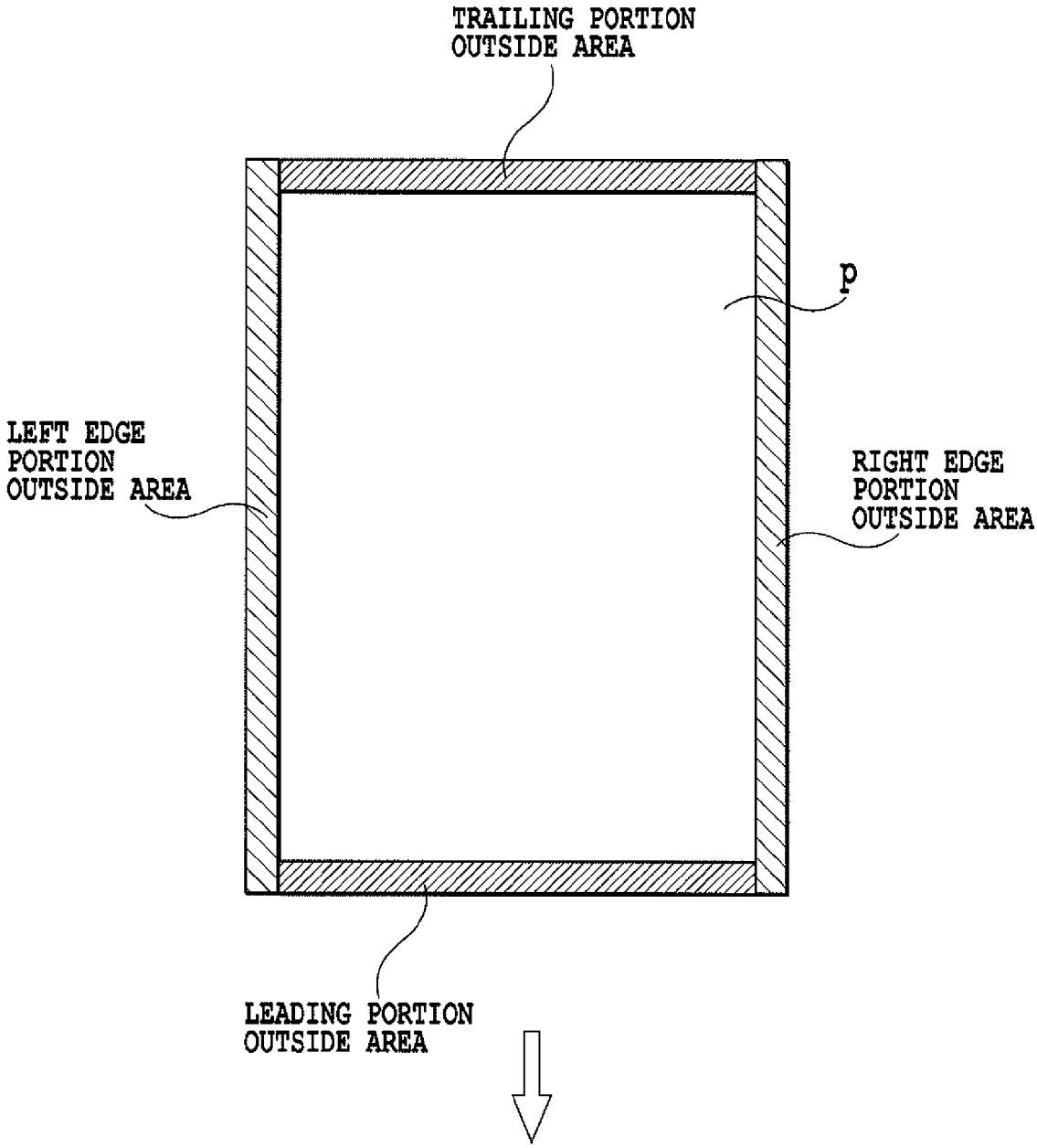
FIG. 7 is an image view for illustrating a counting method of the number of accumulated dots.
Figure 8:
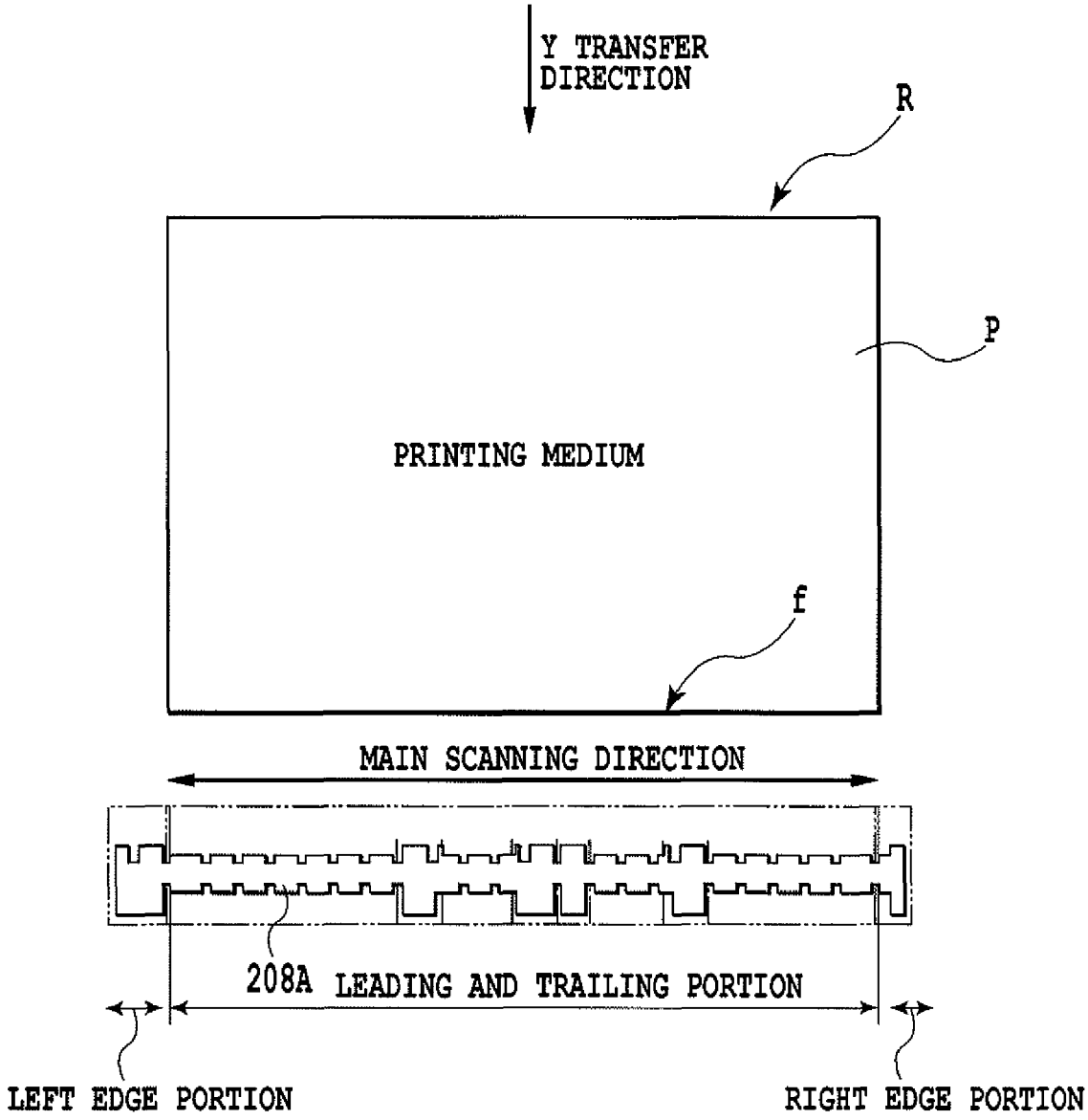
FIG. 8 is a schematic view for illustrating an ink absorber and a distribution of an amount of ink applied.

FIG. 7 is an image view for illustrating a counting method of the number of accumulated dots. As already explained, when "marginless printing" is performed in this embodiment, an image is printed on outside area that overruns an area of the printing medium P and extends to each of the leading portion, the trailing portion, the right edge portion and the left edge portion by 3 mm. In the figure, the area that thus overruns the printing medium P and extends outward is illustrated by oblique lines. Further, assuming that the outside area is divided into a leading portion, a trailing portion, a right edge portion and a left edge portion as illustrated in the figure, and ink ejected to the right edge portion and the left edge portion is absorbed into the right edge portion and the left edge portion of the ink absorber 208A, respectively. Moreover, ink ejected to the leading portion and the trailing portion is absorbed into the leading and trailing portion of the ink absorber 208A illustrated in FIG. 8.

In step S1, the controller 200 in this embodiment counts, for each type of ink, the number of dots of ink absorbed into the right edge portion of the absorber 208A, the number of dots of ink absorbed into the left edge portion and the number of dots of ink absorbed into the leading and trailing portion. Then, the number of dots of dye ink to be used as suppression ink is subtracted from the result of the count of pigmented ink to be used as accumulation ink, whereby the number of accumulated dots is calculated as follows. That is, the number of accumulated dots=the number of cyan dots+the number of magenta dots+the number of yellow dots+the number of pigmented black dots−(the number of light cyan dots+the number of dye black dots+the number of light magenta dots+the number of gray dots+the number of particular color dots).

In step S2, by referring to a table prestored in the ROM 203, the controller 200 determines the number of dots (the number of ejections) of suppression ink in each portion from the number of accumulated dots of each portion obtained in step S1. After that, in step S3, a printing operation for one page is performed. Additionally, the above has explained the case in which the controller 200 calculates the number of accumulated dots, which is the difference between the number of dots of pigmented ink and the number of dots of dye ink, thereby acquiring an accumulation condition of accumulation ink in each portion of the ink absorber 208A. However, information for acquiring the accumulation condition of accumulation ink may be a number of dots of pigmented ink only.

The ink jet printing apparatus of this embodiment applies suppression ink for the number of dots acquired in step S2 to the ink absorber after completion of the printing operation in step S3. For that end, scan (suppression ink application scan) of the carriage independent from the printing operation is performed one time (step S4). At this time, the present invention features that a condition for ejecting suppression ink from the printing head (suppression ink ejection condition) is changeable in each portion so as to complete application of suppression ink, whose amount is different depending on each portion of the ink absorber, by one scan. In this embodiment explained hereinafter, the suppression ink ejection condition is set to carriage scan velocity and the carriage scan velocity varies according to the position of the ink absorber in order to complete application of suppression ink by one scan.

Figure 9:
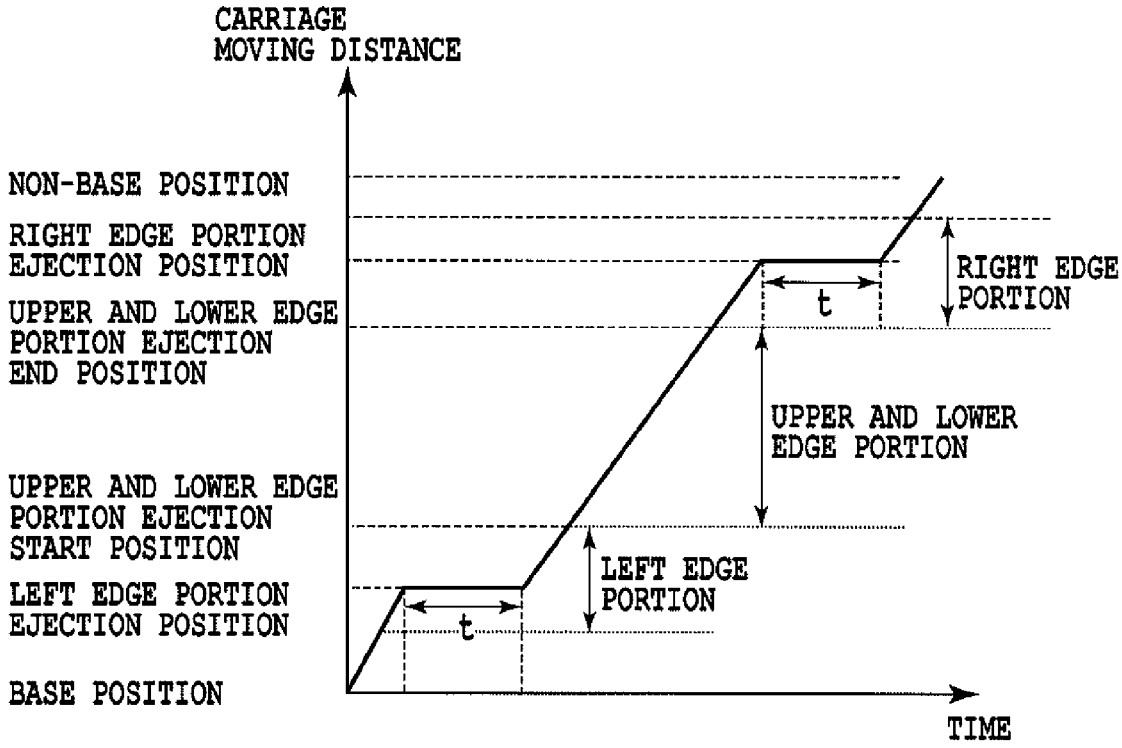
FIG. 9 is a view for illustrating a change in scan velocity in the case of a single suppression ink application scan.

FIG. 9 is a view for illustrating a change in scan velocity in the case of a single suppression ink application scan. This shows a change in scan velocity of the carriage in performing a scan starting from a position corresponding to the further left side of the left edge portion of the absorber, which is called as a base position, to a position corresponding to the further right side of the right edge portion of the absorber, which is called as a non-base position. In the figure, a horizontal axis indicates time elapsed since the start of the carriage from the base position and a vertical axis indicates a moving distance of the carriage. Additionally, in this embodiment, it is assumed that ink is ejected from the nozzle columns of the respective suppression ink, which are mounted on the printing head, at a constant frequency during movement of the carriage.

The carriage started from the base position moves to a left edge ejection position at velocity v, and stops here for time t. It is noted that suppression ink is ejected from each nozzle column at the foregoing constant frequency during the stop time. When time t passes, the carriage moves again to a right edge ejection position at the velocity v, and stops here for time t again. After that, the carriage moves again at the velocity v, and at the point time when the carriage arrives at the non-base position, ejection of suppression ink ends and the suppression ink application scan is completed. By performing such a suppression ink application scan, a large amount of suppression ink is applied to the left edge portion and the right edge portion of the ink absorber as compared with application to the leading and trailing portion. In other words, unlike the conventional case, multiple scans are not required for right and left edge portions, and therefore it is possible to recover ink absorption capability of the ink absorber by one scan in a short period of time.

Referring back to the flowchart in FIG. 6, when one scan ends, the operation proceeds to step S5 and the controller 200 determines whether printing of all pages is completed. When printing of all pages is completed, the present processing is completed. When a page to be printed is still left, the operation goes back to step S1 and processing for a next page is started.

Additionally, in order to perform the suppression ink application scan in step S4, in a table to be referenced in step S2, there may be stored, as a suppression ink ejection condition, the number of nozzles to be used in ejecting suppression ink, an ejection frequency of each nozzle, or a carriage scan velocity. In the case of the number of using nozzles, the table may be prepared such that the number of using nozzles is increased in an area where the number of accumulated dots acquired in step S2 is larger and the number of using nozzles is decreased in an area where the number of accumulated dots is smaller. In the case of the ejection frequency, the table may be prepared such that the ejection frequency is increased in an area where the number of accumulated dots acquired in step S2 is larger and the ejection frequency is decreased in an area where the number of accumulated dots is smaller. Moreover, in the case of the carriage scan velocity, the table may be prepared such that the carriage scan velocity is decreased in an area where the number of accumulated dots acquired in step S2 is larger and the carriage scan velocity is increased in an area where the number of accumulated dots is smaller.

The above has explained the case in which any one of suppression ink ejection conditions is changed in each area according to the number of accumulated dots, but the suppression ink ejection conditions may be combinations of the above-mentioned conditions. In this case, for example, a table may be prepared such that the number of using nozzles and the ejection frequency are increased in an area where the number of accumulated dots acquired in step S2 is larger and the number of using nozzles and the ejection frequency are decreased in an area where the number of accumulated dots is smaller.

However, it is possible to store more items in the table. Regarding the suppression ink ejection condition, for example, stop time t at the right edge portion or left edge portion, and nozzle columns to be used for ejecting suppression ink in addition to the number of nozzles and the ejection frequency or the carriage velocity can be changed according to the number of accumulated dots obtained in step S2. Moreover, the suppression ink ejection condition may be determined that the number of accumulated dots is independently counted in each of the right edge portion, the leading and trailing portion, and the left edge portion in step S1, and the each of the count values thus acquired is combined. In this case, for example, the ejection frequency in only the right and left edge portions is changed to be higher than that in the leading and trailing portion, thereby making it possible to further reduce waiting time t at the right and left edge portions. Furthermore, when the number of suppressed dots to be applied to the leading and trailing portion is small, the carriage velocity is increased while the ejection frequency unchanged, thereby making it possible to complete the suppression ink application scan in a shorter period of time.

Second Embodiment

The first embodiment has explained the case in which the carriage is temporarily stopped to thereby increase the amount of suppression ink to be applied to the left edge portion and the right edge portion. Contrary to this, in this embodiment, the carriage is scanned in such a way to perform reciprocation in the left edge portion and the right edge portion without being stopped to thereby increase the amount of suppression ink to be applied to the left edge portion and the right edge portion. Since the left edge portion and the right edge portion have area of some degree of width, this embodiment allows suppression ink to be uniformly applied to the area.

In this embodiment, it is possible to use the flowchart illustrated in FIG. 6, similar to the first embodiment.

First, in step S1, the number of accumulated dots in the outside area is calculated for each of the right edge portion, the left edge portion and the leading and trailing portion. The method for calculating the number of dots is the same as that in the first embodiment. Sequentially, in step S2, the number of dots of suppression ink (the number of ejections) to each portion is determined by the number of accumulated dots of each of the right edge portion, the left edge portion and the leading and trailing portion acquired in step S1. After that, in step S3, a printing operation for one page is performed.

In this embodiment, it is assumed that the suppression ink ejection conditions changeable in each portion are carriage scan velocity v, the number of scans N of the carriage, and an ejection frequency f for each portion (the left edge portion, the right edge portion and the leading and trailing portion). Then, v, N and f are adjusted according to the number of dots acquired in step S1, thereby performing application of suppression ink appropriate for each portion of the absorber 208A.

Figure 10:
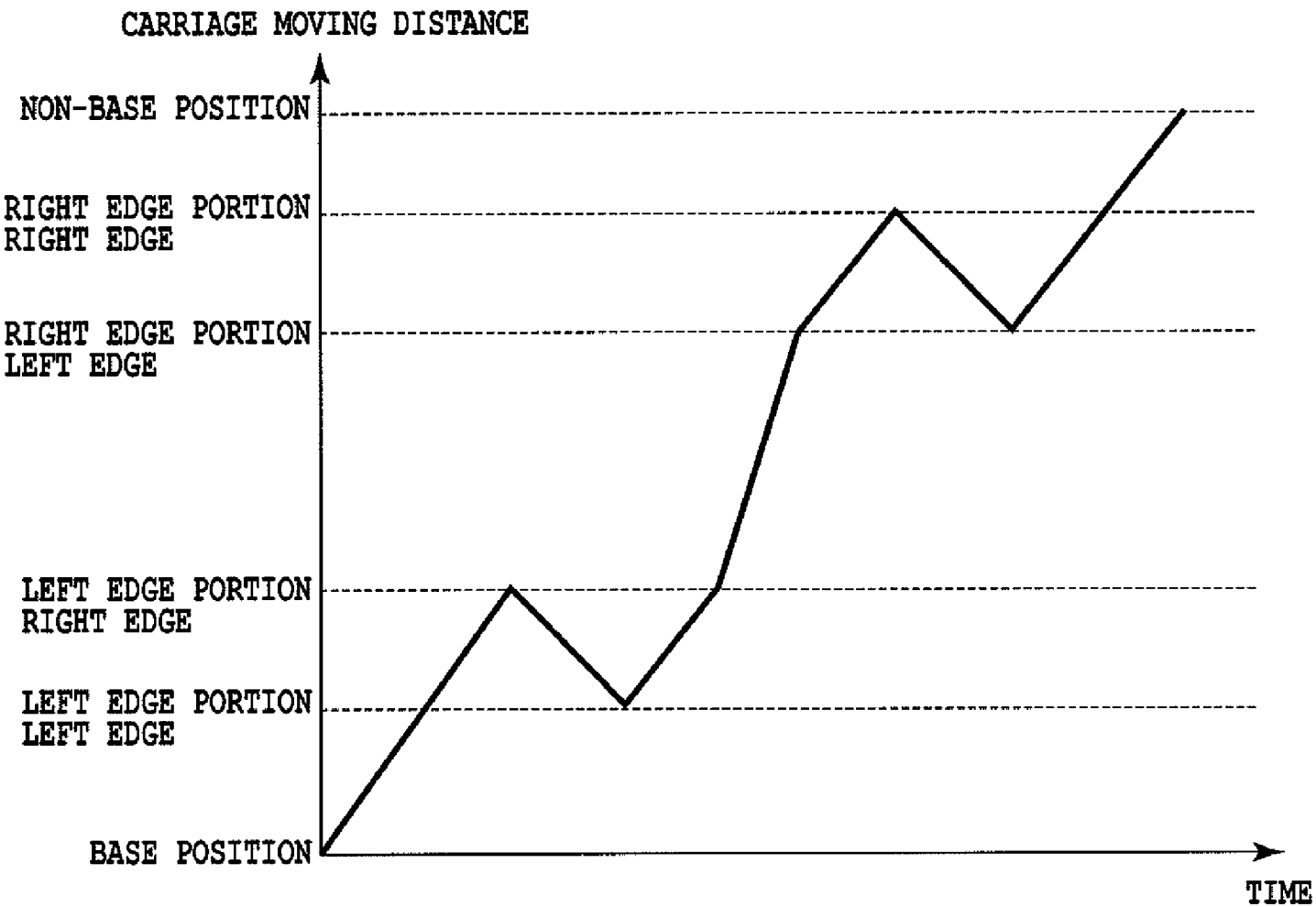
FIG. 10 is a view for illustrating a change in scan velocity in the case of suppression ink application scan according to a second embodiment of the present invention in the same way as the first embodiment.

FIG. 10 is a view for illustrating a change in scan velocity in the case of suppression ink application scan in this embodiment in the same way as the first embodiment. This shows an example in which, in the right edge portion and the left edge portion, carriage velocity is v1, the number of scans of the carriage is three and the ejection frequency is f1, and in the leading and trailing portion, carriage velocity is v2 (>v1), the number of scans of the carriage is one and the ejection frequency is f2 (>f1).

The carriage started from the base position moves to the right edge of the left edge portion at velocity v1, but at the time point when the carriage passes the left edge of the left edge portion, the printing head starts ejection of the suppression ink at frequency f1. When arriving at the right edge of the left edge portion, the carriage reverses its direction of movement and once returns to the left edge of the left edge portion, and further reverses and moves to the right edge of the left edge portion again. During this time, the printing head continues to eject the suppression ink at ejection frequency f1. The aforementioned operation achieves three scans onto the left edge portion at ejection frequency f1.

At the point time when the carriage passes the right edge of the left edge portion, the scan velocity of the carriage is changed to v2 and the ejection frequency of the printing head is changed to f2, and the carriage moves to the left edge of the right edge portion under this condition. This operation achieves one scan onto the leading and trailing portion at ejection frequency f2.

Furthermore, at the point time when the carriage passes the left edge of the right edge portion, the scan velocity of the carriage is changed to v1 and the ejection frequency of the printing head is changed to f1. Similar to the case of the left edge portion, when reaching at the right edge of the right edge portion, the carriage reverses its direction of movement and once returns to the left edge of the right edge portion, and further reverses and moves to the right edge of the right edge portion again. During the time, the printing head continues to eject the suppression ink at ejection frequency f1, and this operation achieves three scans onto the right edge portion at ejection frequency f1.

At the point time when the carriage passes the right edge of the right edge portion, the printing head stops the ejection operation of the suppression ink and the carriage moves to the non-base position directly. Thus, the suppression ink application scan in this embodiment is completed.

According to the above-explained suppression ink application scan, a proper amount of suppression ink is applied to the left edge portion, the right edge portion and the leading and trailing portion of the ink absorber and suppression ink can be uniformly infiltrated into each portion as compared with the first embodiment. In other words, unlike the conventional case, multiple scans are not required for the right edge portion and left edge portion, and therefore it is possible to uniformly recover ink absorption capability of the ink absorber in a short period of time.

Additionally, in FIG. 10, the explanation has been given using the example where the velocity v of the carriage and the ejection frequency f are the same in the left edge portion and the right edge portion, and are different in the leading and trailing portion. However, in this embodiment, the scan velocity v of the carriage, the ejection frequency f and the number of scans N may be independently determined for each of the left edge portion, the right edge portion and the leading and trailing portion. Accordingly, either the carriage velocity or the ejection frequency in the left edge portion and the right edge portion may be changed with respect to the leading and trailing portion, and the carriage can scan the leading and trailing portion multiple times.

Additionally, in the above-explained embodiments, the outside area is divided into the leading portion, trailing portion, the right edge portion and the left edge portion, and the number of accumulated dots is counted. Then, the explanation has been given using an example where the area of the ink absorber, to which the suppression ink is applied with individual suppression ink ejection condition, is divided into the leading and trailing portion, the right edge portion and the left edge portion. However, in the present invention, the division of the area is not limited to three portions, and the suppression ink ejection condition may be determined according to more finely divided portions. For example, the suppression ink application may be performed in such a manner that the leading and trailing portion of the ink absorber is more finely divided in the main scanning directions for counting the number of accumulated dots in each portion and the suppression ink ejection condition is independently determined for each portion. Moreover, when a portion whose number of accumulated dots is large is partially present in the leading and trailing portion, the carriage may be temporarily stopped at the portion. In any case, a table is prepared where various parameters are adjusted such that appropriate amount of suppression ink is infiltrated into each portion of the ink absorber in consideration of accumulation tendency of the accumulation ink and absorption tendency of suppression ink in the absorber. When such a table is provided, this is within the scope of the present invention.

Moreover, in the above explanation, scan for applying suppression ink to the ink absorber is performed after completion of printing operation for one page, but the present invention is not limited to this. For example, even if suppression ink is applied before performing printing operation for one page, it is possible to suppress accumulation ink on the absorber. Moreover, even if scan for applying suppression ink is performed on a multiple page basis or at other suitable timing, instead of on a one page basis, it is possible to obtain the effect of the present invention.

Furthermore, in the above embodiments, the explanation is given on the basis of the assumption that pigmented ink is used as accumulation ink and dye ink is used as suppression ink, however, the actual accumulation ink and suppression ink are not determined by only the color material contained therein. One factor of determining actual accumulation ink and suppression ink is permeability to the ink absorber. A pigmented ink consisting of pigment dispersed in aquatic solvent has low permeability, and tends to remain on absorber. Therefore thus pigmented ink fall into the accumulation ink. On the other hand, a dye ink consisting of water-soluble dye dispersed in aquatic solvent or other ink in which penetrating agent is added are difficult to accumulate on absorber, help an accumulation ink to be absorbed and prevent the accumulation ink from accumulating. Therefore thus ink fall into the suppression ink.

Another factor of determining accumulation ink and suppression ink may be an amount of solvent contained in ink. Because suppression ink containing great amount of solvent can prevent viscosity rise of accumulation ink and help accumulation ink to be absorbed. As a result, pigmented ink which contains great amount of solvent can fall into suppression ink. Therefore, both accumulation ink and suppression ink may be pigmented ink, unlike the above embodiments.

Furthermore, the non-used nozzle column on the printing element substrate 1302 explained in the aforementioned embodiment is assigned to transparent and colorless suppression ink (clear ink) and the clear ink may be applied to the ink absorber solely or preferentially in a suppression ink application scan.

While the present invention has been described with reference to exemplary embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2006-344635, filed Dec. 21, 2006, which is hereby incorporated by reference herein in its entirety.

What is claimed is:

1. An ink jet printing apparatus capable of making a print without providing a margin on edge portions of a printing medium by ejecting at least a first ink from a printing head to the printing medium and to the outside of the printing medium while moving a printing head capable of ejecting the first ink and a second ink onto the printing medium, comprising:

an ink absorber that absorbs the first ink ejected to the outside of the printing medium and the second ink;

an acquisition section that acquires information on accumulation amounts of the first ink at first and second portions of the ink absorber; and a control section that controls ejection of the second ink from the printing head such that the second ink is ejected to the ink absorber, onto which the first ink is ejected, in order to suppress accumulation of the first ink on the ink absorber, wherein the control section changes an ejection condition of the second ink such that an amount of the second ink ejected at the first portion of the ink absorber is larger than an amount of the second ink ejected at the second portion of the ink absorber, wherein the first portion of the ink absorber is outside of the printing medium in the moving direction of the printing head, and the second portion of the ink absorber is outside of the printing medium in the conveying direction of the printing medium, and wherein the ejection condition is changed even when an accumulation amount of the first ink at the first portion of the ink absorber is equivalent to an accumulation amount of the first ink at the second portion of the ink absorber.

2. The ink jet printing apparatus according to claim 1, wherein the ejection condition is a condition including at least one of scan velocity of the printing head, the number of nozzles of the printing head that eject the second ink, an ejection frequency of the printing head and the number of scans performed by the printing head.

3. The ink jet printing apparatus according to claim 1, wherein the control section changes the ejection condition such that the accumulation amount of the first ink ejected onto one of the first and second portions of the ink absorber is larger than the amount of the second ink ejected at the same portion.

4. The ink jet printing apparatus according to claim 1, wherein the first ink contains pigment as a color material and the second ink contains dye as a color material.

5. The ink jet printing apparatus according to claim 1, wherein the first ink and second ink contain pigment as color materials.

6. The ink jet printing apparatus according to claim 1, wherein the first ink is clear ink containing no color material.

7. An ink absorber recovery method in an ink jet printing apparatus having an ink absorber for absorbing ink ejected to the outside of a printing medium, comprising the steps of:

ejecting at least a first ink from a printing head to a printing medium and to the outside of the printing medium while moving the printing head relative to the printing medium, thereby making a print without providing a margin on edge portions of the printing medium, the printing head configured to eject the first ink and a second ink for suppressing accumulation of the first ink on the ink absorber;

acquiring information on accumulation amounts of the first ink at first and second portions of the ink absorber; and changing an ejection condition of the second ink such that, when an accumulation amount of the first ink at the first portion of the ink absorber that is outside of the printing medium in the moving direction of the printing head is equivalent to an accumulation amount of the first ink at the second portion of the ink absorber that is outside of the printing medium in the conveying direction of the printing medium, an amount of the second ink ejected at the first portion is larger than an amount of the second ink ejected at the second portion.

8. The ink jet printing apparatus according to claim 1, wherein the information on an accumulation amount of the first ink is information regarding an ejected number of the first ink from the printing head.

* * * * *